US009230723B2

(12) United States Patent
Kato

(10) Patent No.: US 9,230,723 B2
(45) Date of Patent: Jan. 5, 2016

(54) LAMINATED COMMON MODE CHOKE COIL AND HIGH FREQUENCY COMPONENT

(71) Applicant: Murata Manufacturing Co., Ltd., Kyoto-fu (JP)

(72) Inventor: Noboru Kato, Kyoto-fu (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 14/193,054

(22) Filed: Feb. 28, 2014

(65) Prior Publication Data

US 2014/0176287 A1 Jun. 26, 2014

Related U.S. Application Data

(63) Continuation of application No. PCT/JP2012/071943, filed on Aug. 30, 2012.

(30) Foreign Application Priority Data

Aug. 31, 2011 (JP) ..... 2011-189125
Nov. 25, 2011 (JP) ..... 2011-257519

(51) Int. Cl.
*H01F 5/00* (2006.01)
*H01F 27/24* (2006.01)
(Continued)

(52) U.S. Cl.
CPC ..... *H01F 5/003* (2013.01); *H01F 17/0013* (2013.01); *H01F 19/04* (2013.01); *H01F 2017/0093* (2013.01)

(58) Field of Classification Search
CPC . H01F 5/003; H01F 17/0006; H01F 17/0013; H01F 27/28; H01F 27/2804; H01F 2017/0093; H01F 19/04
USPC ..... 336/200, 234
See application file for complete search history.

(56) References Cited

U.S. PATENT DOCUMENTS 5,552,756 A * 9/1996 Ushiro ..... 336/200

FOREIGN PATENT DOCUMENTS

JP 8-148354 A 6/1996
JP 11-273975 A 10/1999
(Continued)

OTHER PUBLICATIONS

Written Opinion of the International Searching Authority for Application No. PCT/JP2012/071943 dated Dec. 11, 2012.
(Continued)

*Primary Examiner* — Mangtin Lian
(74) *Attorney, Agent, or Firm* — Pearne & Gordon LLP

(57) ABSTRACT

A primary coil is configured by series connection of a first coil element (L1*a*), a second coil element (L1*b*) and a fifth coil element (L1*c*), and a secondary coil is configured by series connection of a third coil element (L2*a*), a fourth coil element (L2*b*) and a sixth coil element (L2*c*). The coil elements (L1*a*, L2*b*, L1*c*) are disposed coaxially and the coil elements (L2*a*, L1*b*, L2*c*) are also disposed coaxially. The respective coil elements (L1*a*, L1*b*, L1*c*) of the primary coil and the respective coil elements (L2*a*, L2*b*, L2*c*) of the secondary coil are disposed adjacently in a layer direction of a base material layer, respectively. The coil elements (L1*a*, L1*b*, L1*c*, L2*a*, L2*b*, L2*c*) are connected in such a manner that a magnetic field in the same direction is generated in all of the coil elements (L1*a*, L1*b*, L1*c*, L2*a*, L2*b*, L2*c*) when common mode current flows.

5 Claims, 24 Drawing Sheets

(51) Int. Cl.
*H01F 17/00* (2006.01)
*H01F 19/04* (2006.01)

(56) References Cited

FOREIGN PATENT DOCUMENTS

| | | | | |
|---|---|---|---|---|
| JP | 2002-57042 | A | | 2/2002 |
| JP | 2003-68528 | A | | 3/2003 |
| JP | 2007-96926 | A | | 4/2007 |
| JP | 2008-98625 | A | | 4/2008 |
| JP | 2010-34464 | A | | 2/2010 |
| JP | 2010-141827 | A | * | 6/2010 |

OTHER PUBLICATIONS

International Search report for Application No. PCT/JP2012/071943 dated Dec. 11, 2012.

* cited by examiner

NORMAL MODE

COMMON MODE

NORMAL MODE

COMMON MODE

NORMAL MODE

LAMINATED COMMON MODE CHOKE COIL AND HIGH FREQUENCY COMPONENT

CROSS-REFERENCE TO RELATED APPLICATIONS

The present application claims priority to JP2011-189125 and JP2011-257519 which are herein incorporated by reference.

TECHNICAL FIELD

The present invention relates to a laminated common mode choke coil to be applied to a transmission line for a high frequency signal, and a high frequency component including the same.

BACKGROUND ART

For example, a high speed interface such as a USB or an HDMI uses a "differential transmission system" for transmitting signals having different phases by 180° through a pair of signal lines. Since radiation noises or external noises are offset in a balanced line, the differential transmission system is hardly influenced by these noises. However, in actuality, noise current in a common mode based on asymmetry of a signal line for a high speed interface is generated particularly in the signal line. For this reason, a common mode choke coil is used in order to control the common mode noise.

Usually, the common mode choke coil is configured as a small-sized laminated chip component including two coils (a primary coil and a secondary coil) wound in the same direction as is disclosed in FIG. 1 of Patent Literature 1, FIG. 2 of Patent Literature 2 and the like. The primary coil and the secondary coil are arranged symmetrically in a lamination direction in a laminated element body.

FIG. 20 is a sectional view showing the common mode choke coil described in the Patent Literature 1. The common mode choke coil has a structure including two coils (laminated coils) 2 and 3 wound coaxially and arranged separately from each other in an axial direction in a laminated element 1, and starting ends and terminating ends of the respective coils 2 and 3 are led to end faces at both sides of the laminated element 1 and are connected to predetermined external electrodes.

CITATION LIST

Patent Literatures

[Patent Literature 1]
Japanese Patent Unexamined Publication No. 2003-068528 bulletin
[Patent Literature 2]
Japanese Patent Unexamined Publication No. 2008-098625 bulletin

SUMMARY OF INVENTION

In the case in which the primary coil and the secondary coil are arranged symmetrically in a lamination direction in a laminated element body, however, there is a problem. For example, a positional shift of a coil pattern or a stacking shift of a sheet is formed. When the coils are provided on a printed wiring board, moreover, it is hard to ensure symmetry thereof due to a structural problem. For example, a coupling amount of each of the coils and a ground conductor on the printed wiring board differs. If the symmetry of the two coils is lacking, removability of the common mode noise is deteriorated.

Moreover, a magnetic material is used as the laminated element body in some cases. However, the magnetic material has a comparatively great frequency characteristic. For this reason, a loss of a normal mode signal particularly in a high frequency band tends to be increased. Moreover, a sufficient coupling value cannot be obtained between the primary coil and the secondary coil particularly in the high frequency band, and thus a loss of a normal mode signal tends to be increased.

The present invention has been made to solve the problems, and an object thereof is to provide a small-sized common mode choke coil having a small loss of a normal mode signal and high removability of a common mode noise, and a high frequency component including the same.

A laminated common mode choke coil according to the present invention has a laminated element body obtained by laminating a plurality of base material layers, and a primary coil and a secondary coil which are provided on the laminated element body and are coupled to each other, and the primary coil includes a first coil element and a second coil element which are connected in series and the secondary coil includes a third coil element and a fourth coil element which are connected in series, the first coil element and the fourth coil element are wound around a first winding axis, and the second coil element and the third coil element are wound around a second winding axis which is different from the first winding axis, the first coil element and the third coil element are disposed adjacently in a layer direction of the base material layer (an orthogonal direction to a lamination direction), and the second coil element and the fourth coil element are disposed adjacently in the layer direction of the base material layer, and the first coil element, the second coil element, the third coil element and the fourth coil element are connected in such a manner that a magnetic field in the same direction is generated in the first coil element, the second coil element, the third coil element and the fourth coil element when common mode current flows.

A high frequency component according to the present invention includes a common mode choke coil, the common mode choke coil being a laminated common mode choke coil having a laminated element body obtained by laminating a plurality of base material layers, and a primary coil and a secondary coil which are provided on the laminated element body and are coupled to each other, wherein the primary coil includes a first coil element and a second coil element which are connected in series and the secondary coil includes a third coil element and a fourth coil element which are connected in series, the first coil element and the fourth coil element are wound around a first winding axis, and the second coil element and the third coil element are wound around a second winding axis which is different from the first winding axis, the first coil element and the third coil element are disposed adjacently in a layer direction of the base material layer (an orthogonal direction to a lamination direction), and the second coil element and the fourth coil element are disposed adjacently in the layer direction of the base material layer, and the first coil element, the second coil element, the third coil element and the fourth coil element are connected in such a manner that a magnetic field in the same direction is generated in the first coil element, the second coil element, the third coil element and the fourth coil element when common mode current flows.

According to the present invention, the problem in the process (the forming of positional shift of the coil pattern, the stacking shift of the sheet or the like) and the structural problem (the problem in which the coupling amount of each coil and the ground conductor on the printed wiring board differs when they are provided on the printed wiring board) are hardly caused, and excellent symmetry can be ensured. Moreover, a degree of coupling of the primary coil and the secondary coil is increased. Therefore, a great inductance value is obtained for a common mode signal so that an impedance is increased, and the inductance value is reduced for a normal mode signal so that the impedance is reduced. Accordingly, it is possible to obtain a small-sized common mode choke coil having a small loss of the normal mode signal and high removability of a common mode noise, and a high frequency component including the same.

DESCRIPTION OF EMBODIMENTS

First Embodiment

Figure 1:
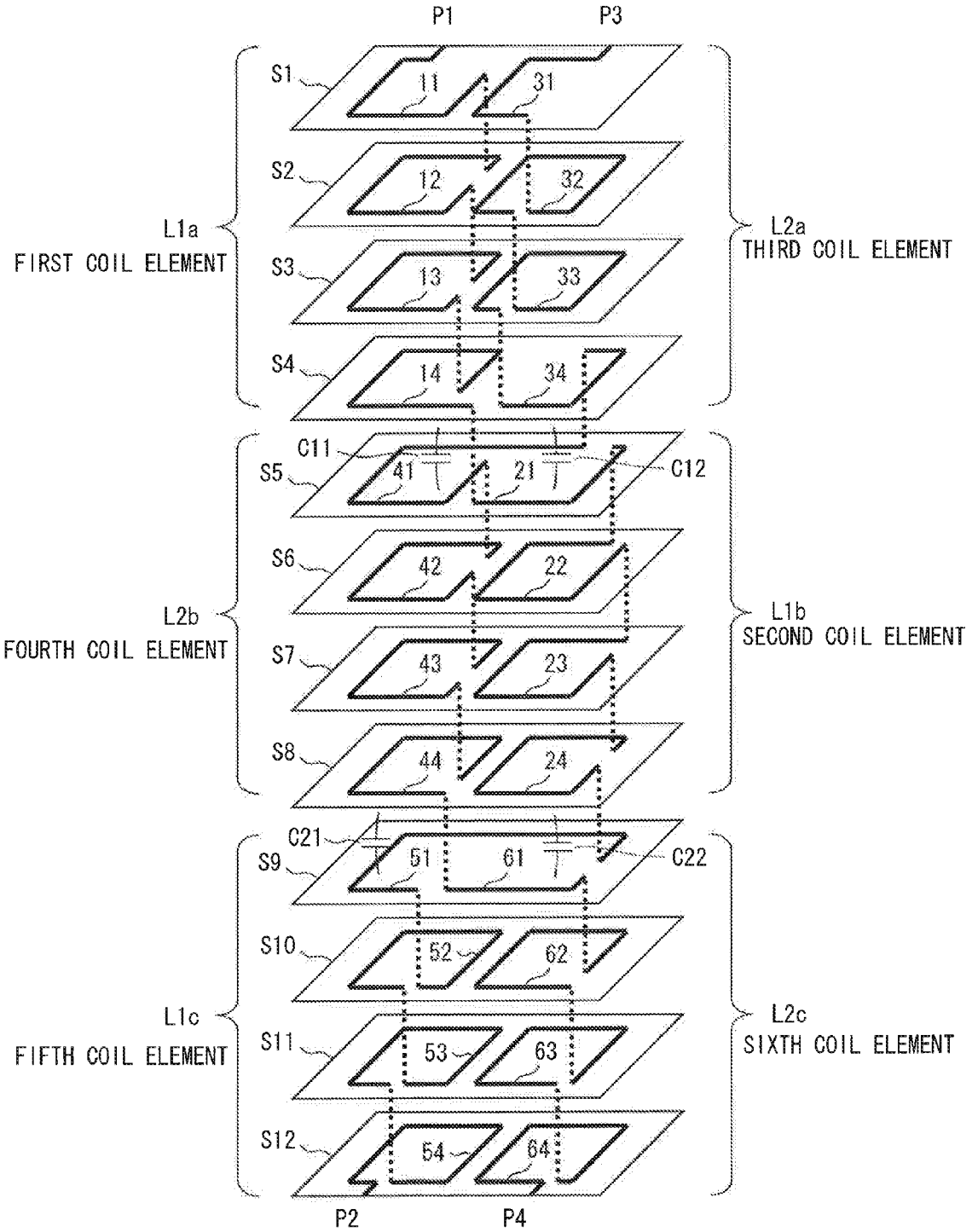
FIG. 1 is an exploded perspective view showing a common mode choke coil according to a first embodiment.
Figure 2:
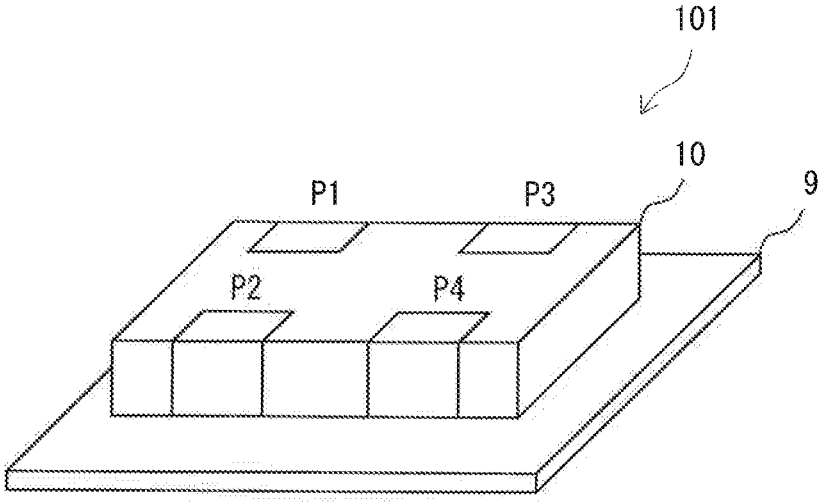
FIG. 2 is a perspective view showing a state in which a common mode choke coil 101 is mounted on a printed wiring board 9 according to the first embodiment.

FIG. 1 is an exploded perspective view showing a common mode choke coil according to a first embodiment. FIG. 2 is a perspective view showing a state in which a common mode choke coil 101 is mounted on a printed wiring board 9 according to the first embodiment.

The common mode choke coil 101 is a laminated common mode choke coil having a laminated element body 10 obtained by laminating a plurality of base material layers including base material layers S1 to S12 and a primary coil and a secondary coil which are provided on the laminated element body and are coupled to each other.

As shown in FIG. 1, conductor patterns are formed on the base material layers S1 to S12. Conductor patterns 11 to 14, conductor patterns 21 to 24 and conductor patterns 51 to 54 are formed on the base material layers S1 to S4, the base material layers S5 to S8 and the base material layers S9 to S12, respectively. Moreover, conductor patterns 31 to 34, conductor patterns 41 to 44 and conductor patterns 61 to 64 are formed on the base material layers S1 to S4, the base material layers S5 to S8 and the base material layers S9 to S12, respectively. Dashed lines extending in a vertical direction in FIG. 1 indicate via conductors, which connect the conductor patterns to each other using interlayers.

A first coil element L1*a* is formed by the conductor patterns 11 to 14 and via conductors connecting them. Moreover, a second coil element L1*b* is formed by the conductor patterns 21 to 24 and via conductors connecting them. Furthermore, a fifth coil element L1*c* is formed by the conductor patterns 51 to 54 and via conductors connecting them. In addition, a third coil element L2*a* is formed by the conductor patterns 31 to 34 and via conductors connecting them. Moreover, a fourth coil element L2*b* is formed by the conductor patterns 41 to 44 and via conductors connecting them. Furthermore, a sixth coil element L2*c* is formed by the conductor patterns 61 to 64 and via conductors connecting them.

In FIG. 1, an end of the first coil element L1*a* is used as a port P1 and an end of the fifth coil element L1*c* is used as a port P2. Moreover, an end of the third coil element L2*a* is used as a port P3 and an end of the sixth coil element L2*c* is used as a port P4.

As is illustrated in FIG. 2, external electrodes serving as the input/output ports P1, P2, P3 and P4 are formed on an external surface of the laminated element body 10.

Figure 3:
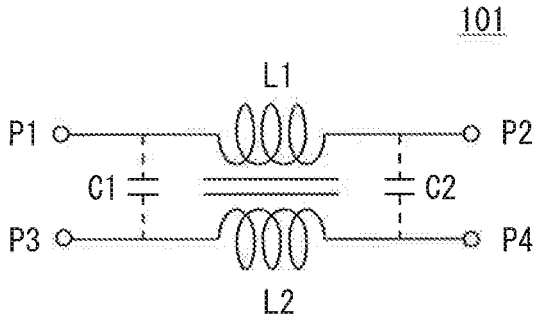
FIG. 3 is an equivalent circuit diagram showing the common mode choke coil 101.

FIG. 3 is an equivalent circuit diagram showing the common mode choke coil 101. By the structure described above, a primary coil L1 has first and second ends serving as the ports P1 and P2, respectively, and a secondary coil L2 has first and second ends serving as the ports P3 and P4, respectively. In other words, the primary coil L1 includes a series circuit formed by the first coil element L1*a*, the second coil element L1*b* and the fifth coil element L1*c*. Moreover, the secondary coil L2 includes a series circuit formed by the third coil element L2*a*, the fourth coil element L2*b* and the sixth coil element L2*c*.

Thus, the primary coil L1 and the secondary coil L2 are provided in a pair of signal lines forming a balanced line respectively, and are coupled through a great coupling value.

Although each coil element is a laminated coil in the example shown in FIG. 1, each coil element may be a planar coil formed on the same plane. It is sufficient that the coil element is configured by a coil pattern having at least one turn.

The respective coil elements are disposed respectively in such a manner that winding axes of the first coil element L1*a*, the fourth coil element L2*b* and the fifth coil element L1*c* are positioned almost coaxially and winding axes of the third coil element L2*a*, the second coil element L1*b* and the sixth coil element L2*c* are positioned almost coaxially. Moreover, the first coil element L1*a* and the third coil element L2*a* are disposed adjacently in a layer direction of the base material layer (an orthogonal direction to the lamination direction) in such a manner that coil apertures of the respective coil elements are adjacent to each other in planar view. The second coil element L1*b* and the fourth coil element L2*b* are disposed adjacently in such a manner that the coil apertures of the respective coil elements are adjacent to each other in planar view. Furthermore, the fifth coil element L1*c* and the sixth coil element L2*c* are disposed adjacently in such a manner that the coil apertures of the respective coil elements are adjacent to each other in planar view. In other words, the primary coil L1 and the secondary coil L2 are disposed adjacently and symmetrically in the lamination direction of the base material layer and are disposed adjacently and symmetrically in the plane direction of the base material layer. Although the first coil element L1*a*, the fourth coil element L2*b* and the fifth coil element L1*c* are disposed in such a manner that the winding axes of the respective coil elements are positioned almost coaxially in the present embodiment, it is sufficient that they should be disposed in such a manner that the coil apertures of the respective coil elements overlap with each other in planar view. The third coil element L2*a*, the second coil element L1*b* and the sixth coil element L2*c* are also the same.

A magnetic material (a dielectric material having a high magnetic permeability) can be used as a material for the base material layer in terms of a confinement property of magnetic energy since an eddy-current loss is relatively small when a common mode choke coil for an HF band is formed. However, when a common mode choke coil for a UHF band is formed, for example, it may be preferable to use a dielectric material having a high electric insulation resistance in order to suppress the eddy-current loss in a high frequency region. A magnetic material represented by ferrite has a frequency characteristic in a magnetic permeability. For this reason, the loss is increased with an increase in a utilization frequency band. Since the dielectric has a comparatively small frequency characteristic, however, it is possible to implement a laminated common mode choke coil having a small loss in a wide frequency band. According to the present invention, a closed magnetic circuit including a plurality of coil elements is utilized as described above. Therefore, it is not always necessary to use a magnetic base material and it is possible to implement a choke coil having a small frequency characteristic by using a dielectric body. The base material layer may be a dielectric ceramic layer such as low temperature co-fired ceramics (LTCC) or a resin layer formed by a thermoplastic resin or a thermosetting resin.

Moreover, it may be preferable to use a metallic material containing, as a main component, a metal having a low specific resistance such as copper or silver as each of the coil elements, a wiring line for connecting the respective coil elements, a wiring line for connecting each of the coil elements to an external terminal or the like.

According to the present invention, even if the magnetic material such as ferrite is not used for the base material layer, it is possible to strongly couple the primary coil to the secondary coil. By using the dielectric for the base material layer, therefore, it is possible to prevent the loss of the normal mode signal particularly in the high frequency band from being increased.

A stray capacitance is generated between adjacent conductor patterns. As illustrated by C11, C12, C21 and C22 in FIG. 1, particularly, a potential difference between the conductor pattern on the primary coil side and the conductor pattern on the secondary coil side is great in a crossing part of the primary coil and the secondary coil. For this reason, a comparatively large capacitance is generated in that part. The capacitors C1 and C2 in FIG. 3 equivalently represent the stray capacitances C11, C12, C21 and C22.

FIGS. 4A and 4B and FIGS. 5A and 5B are views showing currents and directions of magnetic fluxes in a common mode and a normal mode (a differential mode), respectively in the common mode choke coil according to the first embodiment.

Figure 4A:
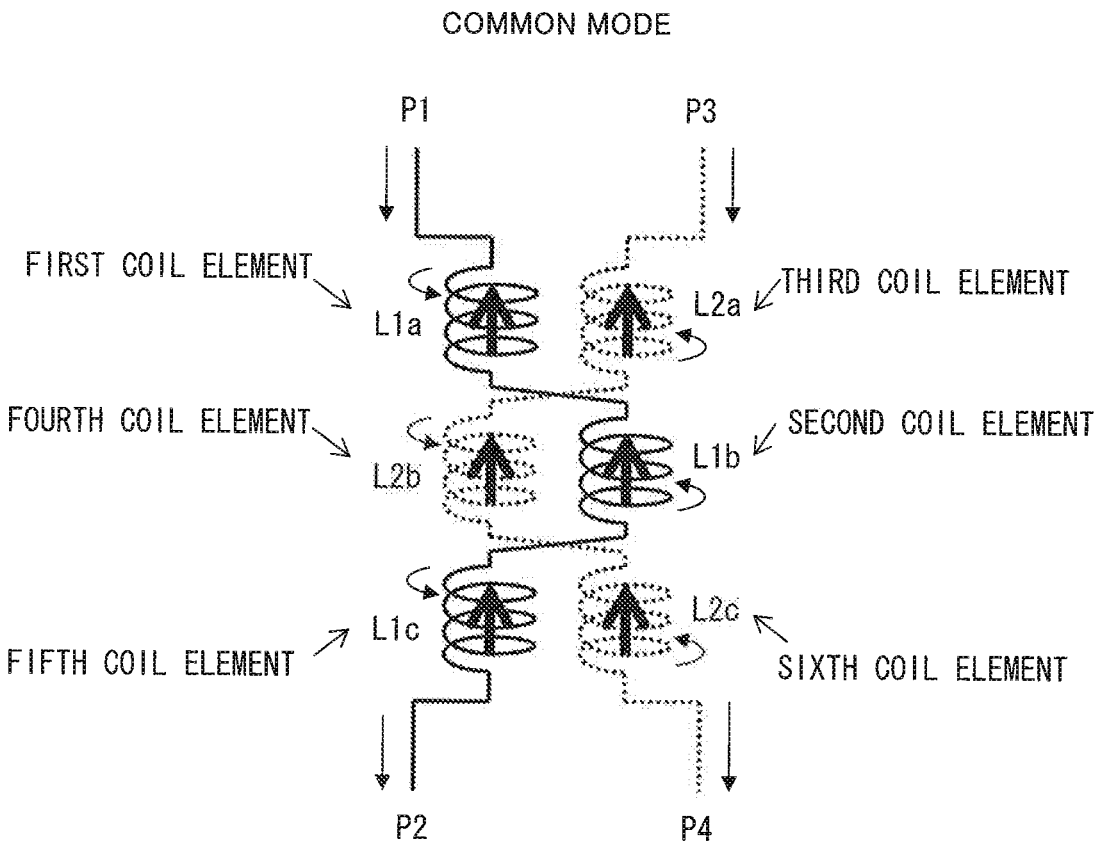
FIG. 4A is a view showing common mode current and a direction of a magnetic flux generated by the same.

As shown in FIG. 4A, when the common mode current flows, a direction of a magnetic flux generated on the primary coil formed by the first coil element L1*a*, the second coil element L1*b* and the fifth coil element L1*c* is coincident with a direction of a magnetic flux generated on the secondary coil formed by the third coil element L2*a*, the fourth coil element L2*b* and the sixth coil element L2*c*. Therefore, magnetic fields are mutually increased so that a great inductance value can be obtained. Consequently, impedance is increased so that the common mode current (a common mode noise) is suppressed.

Figure 4B:
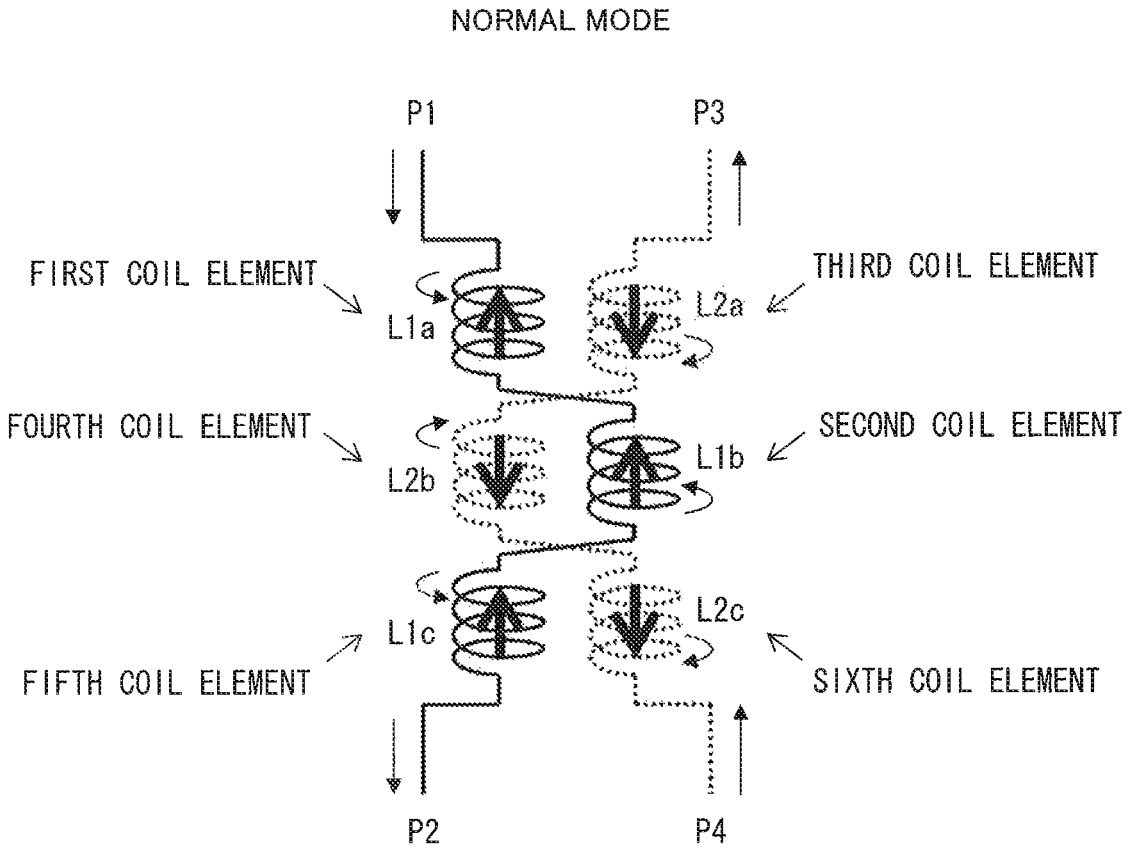
FIG. 4B is a view showing normal mode current and a direction of a magnetic flux generated by the same.

As shown in FIG. 4B, when the normal mode current flows, the direction of the magnetic flux generated on the primary coil formed by the first coil element L1*a*, the second coil element L1*b* and the fifth coil element L1*c* is in the reverse direction of the magnetic flux generated on the secondary coil formed by the third coil element L2*a*, the fourth coil element L2*b* and the sixth coil element L2*c*. Therefore, the magnetic fields are mutually reduced so that the inductance value is decreased. Consequently, the impedance is reduced so that the normal mode current (a normal mode signal) is transmitted with a small loss.

Figure 5A:
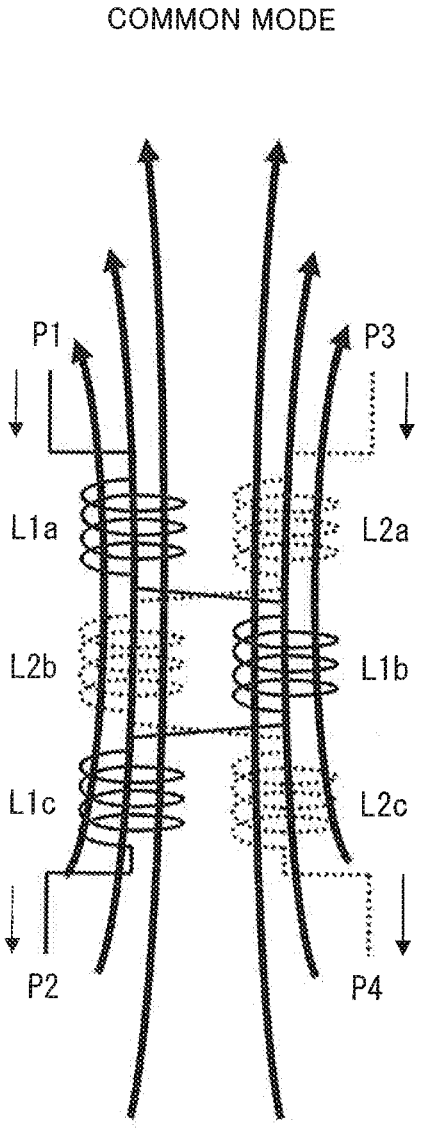
FIG. 5A is a view showing a state of the magnetic flux generated by the common mode current.
Figure 5B:
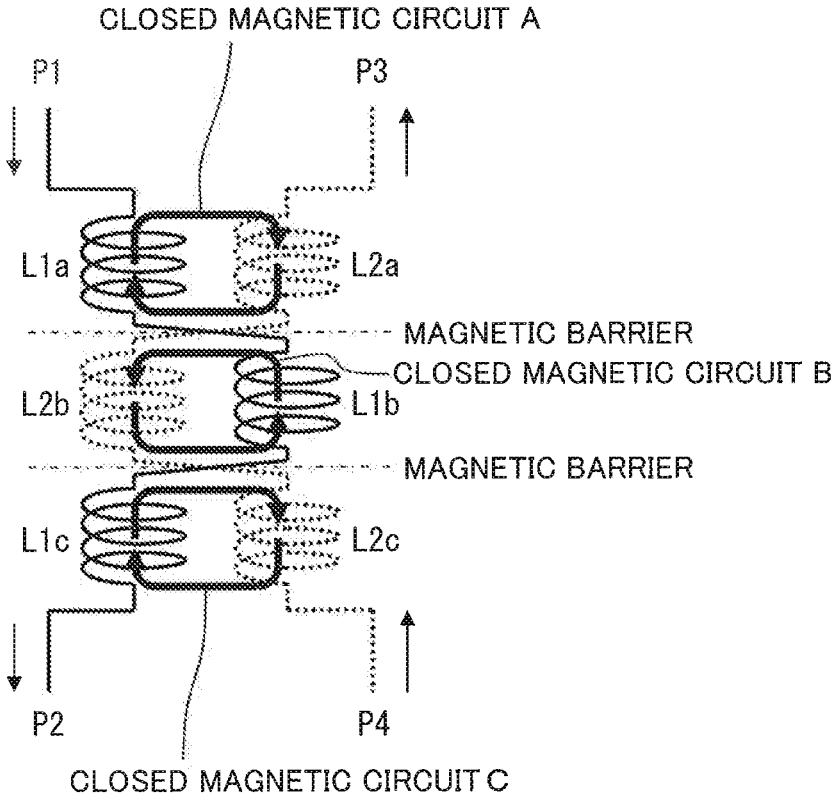
FIG. 5B is a view showing a state of the magnetic flux generated by the normal mode current.

A relationship between the direction of the magnetic flux generated on each of the coil elements and the inductance described above is more apparent from FIGS. 5A and 5B. A magnetic path of the magnetic flux generated when the common mode current shown in FIG. 4A flows forms an open magnetic circuit as illustrated in FIG. 5A. Accordingly, the inductance value is great. On the other hand, referring to a magnetic path of a magnetic flux generated when the normal mode current flows as shown in FIG. 4B, a closed magnetic circuit A includes the first coil element L1*a* and the third coil element L2*a*, a closed magnetic circuit B includes the fourth coil element L2*b* and the second coil element L1*b*, and a closed magnetic circuit C includes the fifth coil element L1*c* and the sixth coil element L2*c* as illustrated in FIG. 5B. Since all of the magnetic paths are thus closed, the inductance value is small. In particular, the directions of the magnetic fluxes of the coil elements which are adjacent to each other in a coil winding axis direction are the reverse of each other (a direction in which the magnetic fluxes repel each other). Therefore, a magnetic barrier is generated between the coil elements. In other words, a first magnetic barrier is generated between the closed magnetic circuit A and the closed magnetic circuit B, and a second magnetic barrier is generated between the closed magnetic circuit B and the closed magnetic circuit C. Since the closed magnetic circuit B is interposed between the two magnetic barriers, accordingly, it has a high confinement property of a magnetic field so that a leakage flux can be suppressed more greatly. Therefore, a sufficient coupling value can be obtained between the primary coil and the secondary coil.

In other words, displacement current and induction current flow in the same direction through the first coil element L1*a* and the fourth coil element L2*b*, and the displacement current and the induction current flow in the same direction through the second coil element L1*b* and the third coil element L2*a*. Similarly, the displacement current and the induction current flow in the same direction through the fourth coil element L2*b* and the fifth coil element L1*c*, and the displacement current and the induction current flow in the same direction through the second coil element L1*b* and the sixth coil element L2*c*. As a result, a transmission loss of the normal mode signal is reduced.

It may be preferable that the first coil element L1*a* and the third coil element L2*a* are formed on the same base material layer and the second coil element L1*b* and the fourth coil element L2*b* are formed on the same base material layer. Similarly, it may be preferable that the fifth coil element L1*c* and the sixth coil element L2*c* are also formed on the same base material layer. A pattern can be formed on the same base material layer by the same process, for example, screen printing. Therefore, a positional shift of a conductor pattern hardly occurs. If a stacking shift of the base material layer occurs, the conductor patterns of the layers are shifted from each other or a positional relationship between the conductor patterns of the primary coil and the secondary coil in the respective base material layers is determined with high precision. Therefore, the symmetry of the primary coil and the secondary coil is ensured so that removability of a predetermined common mode noise can be obtained.

Moreover, capacitances generated between the ground conductor formed on the printed wiring board 9 and the conductor patterns 54 and 64 are almost equal to each other. Also in this respect, the symmetry of the primary coil and the secondary coil can be ensured.

The stray capacitances C11, C12, C21 and C22 are generated in positions where the coil open surfaces of adjacent coil elements in the axial direction are opposed to each other. Therefore, they act as capacitances connected between the respective coil elements. These capacitances are determined depending on line widths of the opposed conductor patterns and thicknesses of the base material layers. As will be described below, it is possible to determine a cutoff frequency with respect to the common mode current by regulating the capacitance together with the inductance value in the normal mode of each of the coil elements. In addition, it is also possible to configure a low pass filter in the normal mode signal or to determine a characteristic impedance in the normal mode.

Figure 6:
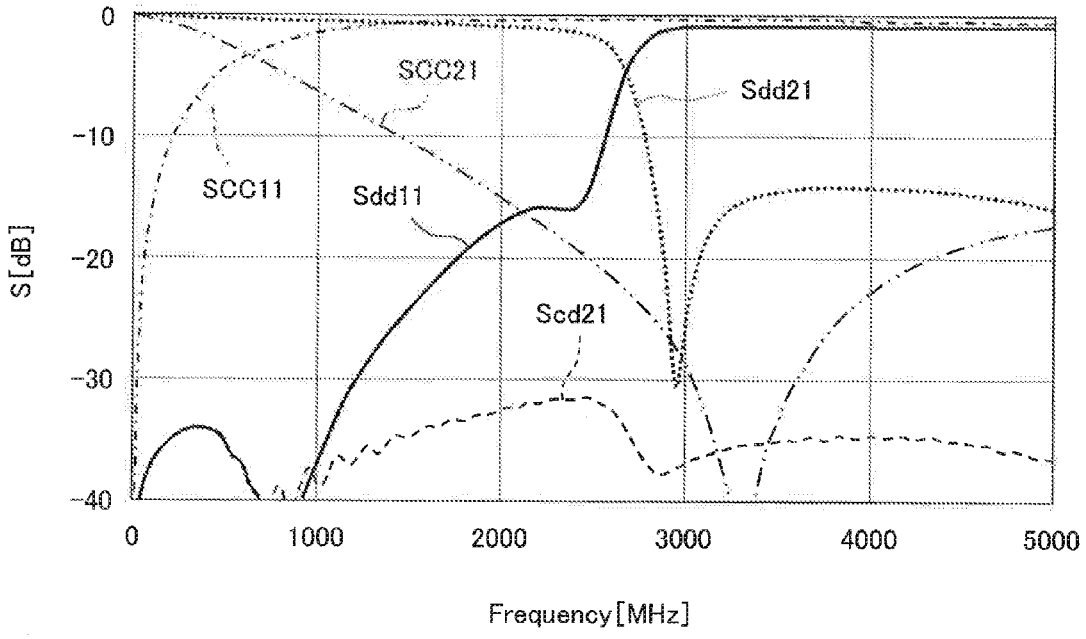
FIG. 6 is a chart showing a frequency characteristic obtained by actual measurement of the common mode choke coil according to the first embodiment.

FIG. 6 is a chart showing a frequency characteristic obtained through actual measurement of the common mode choke coil according to the first embodiment when a plane size of the laminated body is 16×8 mm, a thickness is 5 mm and an interval between the respective layers is 25 μm. The meaning of each characteristic curve is as follows: Sdd11) reflection characteristic in normal mode; Sdd21) passage characteristic in normal mode; Scc11) reflection characteristic in common mode; Scc21) passage characteristic in common mode; and Scd21) frequency characteristic in amount of conversion of common mode into normal mode.

As is apparent from Sdd11 (the reflection characteristic of the normal mode signal) in FIG. 6, a low reflection characteristic is obtained for the normal mode signal within a frequency range of 500 MHz to 2500 MHz. This characteristic is obtained by the action of the LC low pass filter including the primary coil L1, the secondary coil L2 and the capacitors C1 and C2 shown in FIG. 3. As is apparent from Sdd21 (the passage characteristic of the normal mode signal), moreover, a low insertion loss characteristic is obtained for the normal mode signal at a frequency of 2500 MHz or less. This characteristic is a low pass filter characteristic having a cut-off frequency in the vicinity of 2700 MHz. The low pass filter characteristic is obtained by the action of the LC low pass filter including the primary coil L1, the secondary coil L2 and the capacitors C1 and C2 shown in FIG. 3. As is apparent from Scc11 (a reflection characteristic of a common mode noise), a low reflection characteristic is obtained for the common mode noise at a frequency of 500 MHz or more. As is apparent from Scc21 (a passage characteristic of the common mode noise), a great attenuation characteristic is obtained for the common mode signal at a frequency of 500 MHz or more. A pole is formed in the vicinity of 3300 MHz through this characteristic because of self-resonance of an inductance which is generated in the common mode. As is apparent from Scd21 (the amount of the conversion from the common mode into the normal mode), −30 db or less is obtained in all frequency bands and the suppression is sufficiently carried out.

By the low pass filter characteristic of Sdd21 (the passage characteristic of the normal mode signal), it is possible to attenuate a harmonic signal of a normal signal, thereby suppressing a ringing noise. Therefore, it is not necessary to separately provide a balance type low pass filter in addition to the common mode choke coil, for example. Thus, the number of components can be reduced so that a cost can be cut down. Furthermore, an eye pattern characteristic of a differential transmission line can be enhanced by the suppression in the ringing noise. Consequently, a digital signal can be stabilized.

Second Embodiment

Figure 7:
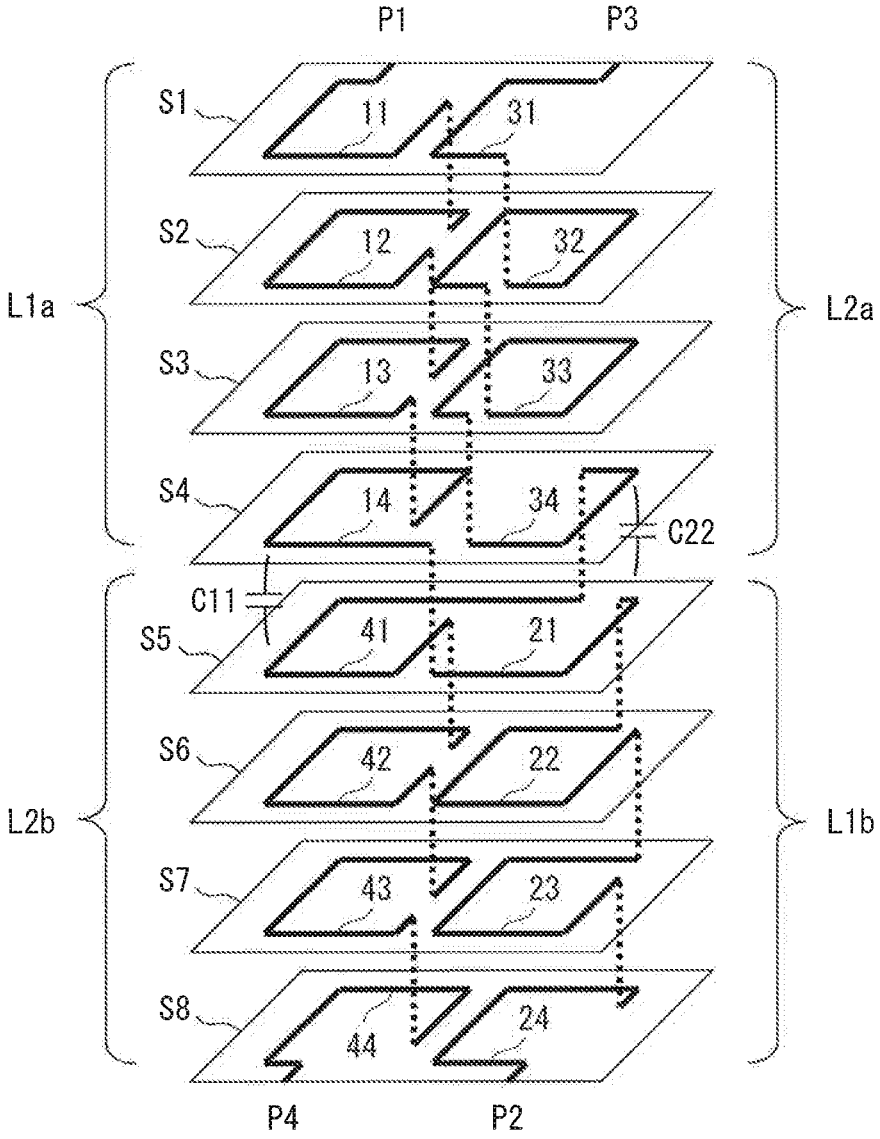
FIG. 7 is an exploded perspective view showing a common mode choke coil according to a second embodiment.
Figure 8:
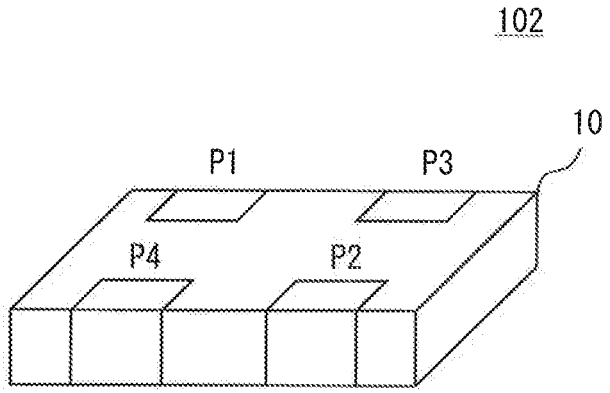
FIG. 8 is a perspective view showing a common mode choke coil 102 according to the second embodiment.

FIG. 7 is an exploded perspective view showing a common mode choke coil according to a second embodiment. FIG. 8 is a perspective view showing a common mode choke coil 102 according to the second embodiment.

The common mode choke coil 102 is a laminated common mode choke coil having a laminated element body 10 obtained by laminating a plurality of base material layers including base material layers S1 to S8 and a primary coil and a secondary coil which are provided on the laminated element body and are coupled to each other.

As shown in FIG. 7, conductor patterns are formed on the base material layers S1 to S8. Conductor patterns 11 to 14 and conductor patterns 21 to 24 are formed on the base material layers S1 to S4 and the base material layers S5 to S8, respectively. Moreover, conductor patterns 31 to 34 and conductor patterns 41 to 44 are formed on the base material layers S1 to S4 and the base material layers S5 to S8, respectively. Dashed lines extending in a vertical direction in FIG. 7 indicate via conductors, which connect the conductor patterns to each other using interlayers.

A first coil element L1*a* is formed by the conductor patterns 11 to 14 and via conductors connecting them. Moreover, a second coil element L1*b* is formed by the conductor patterns 21 to 24 and via conductors connecting them. Furthermore, a third coil element L2*a* is formed by the conductor patterns 31 to 34 and via conductors connecting them. Moreover, a fourth coil element L2*b* is formed by the conductor patterns 41 to 44 and via conductors connecting them.

In FIG. 7, an end of the first coil element L1*a* is used as a port P1 and an end of the second coil element L1*b* is used as a port P2. Moreover, an end of the third coil element L2*a* is used as a port P3 and an end of the fourth coil element L2*b* is used as a port P4.

In the second embodiment, the primary coil includes a series circuit formed by the two coil elements L1*a* and L1*b*, and the secondary coil includes a series circuit formed by the two coil elements L2*a* and L2*b*. In other words, the primary coil and the secondary coil cross each other only once. Consequently, take-out positions of the ports P1 to P4 are different from those in the common mode choke coil 101 described in the first embodiment. The others are the same as those in the common mode choke coil 101 according to the first embodiment.

As is illustrated in FIG. 8, external electrodes serving as the input/output ports P1, P2, P3 and P4 are formed on an external surface of the laminated element body 10.

Figure 9:
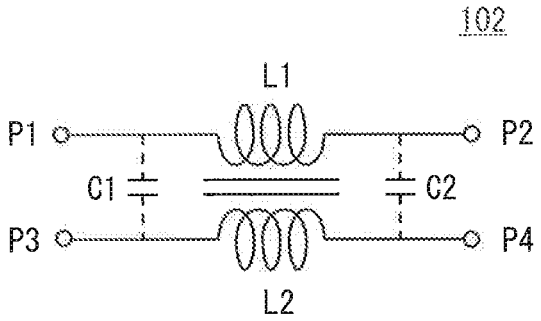
FIG. 9 is an equivalent circuit diagram showing the common mode choke coil 102.

FIG. 9 is an equivalent circuit diagram showing the common mode choke coil 102. By the structure described above, a primary coil L1 has first and second ends serving as ports P1 and P2, respectively and a secondary coil L2 has first and second ends serving as ports P3 and P4, respectively.

As illustrated by C11 and C22 in FIG. 7, a potential difference between the conductor pattern on the primary coil side and the conductor pattern on the secondary coil side is great in a crossing part of the primary coil and the secondary coil. For this reason, a comparatively large capacitance is generated in that part. Capacitors C1 and C2 in FIG. 9 equivalently represent the stray capacitances C11 and C22.

Figure 10A:
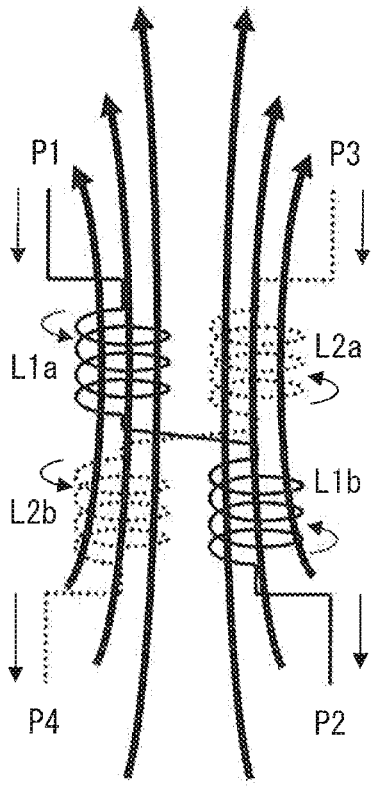
FIGS. 10A and 10B are views showing directions of currents and magnetic fluxes in a common mode and a normal mode, respectively in the common mode choke coil according to the second embodiment.
Figure 10B:
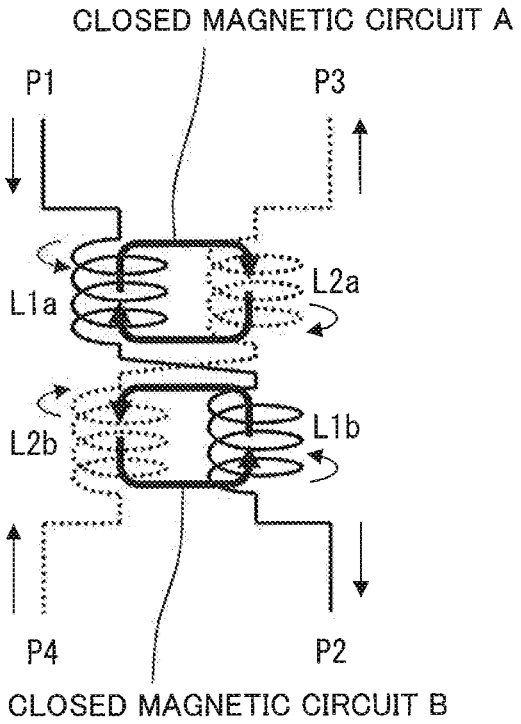

FIGS. 10A and 10B are views showing directions of currents and magnetic fluxes in a common mode and a normal mode (a differential mode), respectively in the common mode choke coil according to the second embodiment.

As shown in FIG. 10A, when the common mode current flows, a direction of a magnetic flux generated on the primary coil formed by the first coil element L1*a* and the second coil element L1*b* is coincident with a direction of a magnetic flux generated on the secondary coil formed by the third coil element L2*a* and the fourth coil element L2*b*. Therefore, magnetic fields are mutually increased so that a great inductance value can be obtained. Consequently, impedance is increased so that the common mode current (a common mode noise) is suppressed.

As shown in FIG. 10B, when the normal mode current flows, the direction of the magnetic flux generated on the primary coil formed by the first coil element L1*a* and the second coil element L1*b* is the reverse direction of the magnetic flux generated on the secondary coil formed by the third coil element L2*a* and the fourth coil element L2*b*. Therefore, the magnetic fields are mutually reduced so that the inductance value is decreased. Consequently, the impedance is reduced so that normal mode current (a normal mode signal) is transmitted with a small loss.

Thus, it is possible to configure a common mode choke coil including the primary coil and the secondary coil by four coil elements in total.

Third Embodiment

Figure 11:
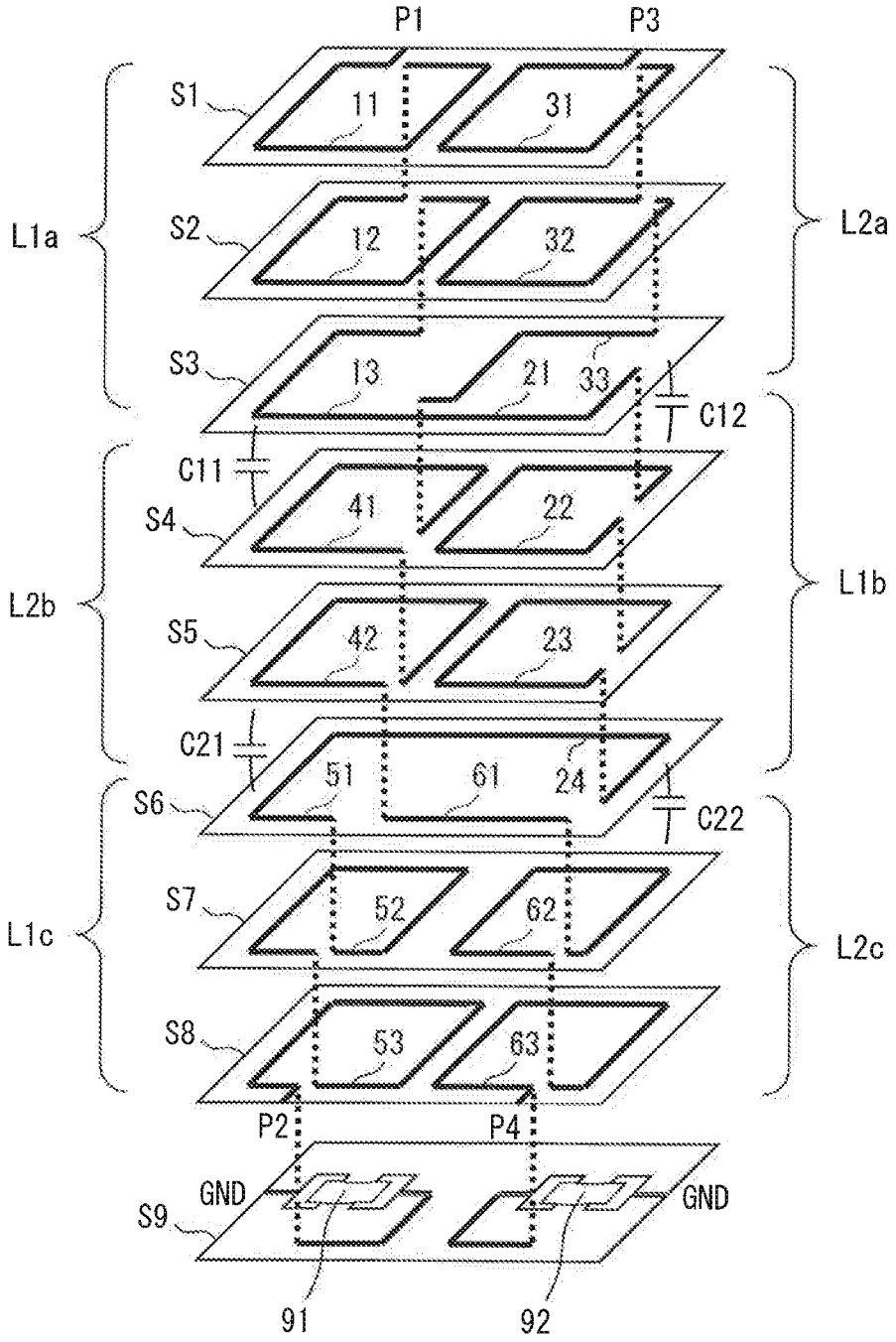
FIG. 11 is an exploded perspective view showing a high frequency component according to a third embodiment.
Figure 12:
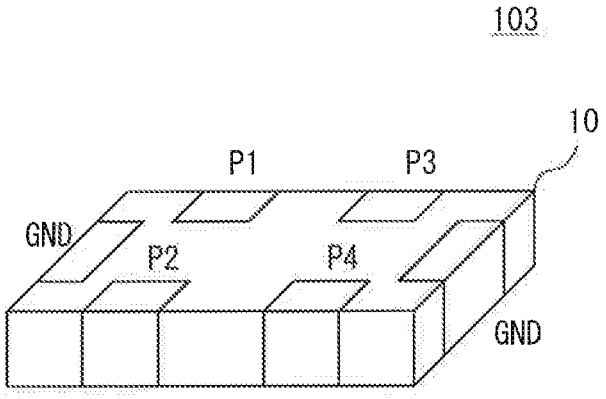
FIG. 12 is a perspective view showing a high frequency component 103 according to the third embodiment.

FIG. 11 is an exploded perspective view showing a high frequency component according to a third embodiment. FIG. 12 is a perspective view showing a high frequency component 103 according to the third embodiment.

The high frequency component 103 includes a laminated common mode choke coil having a laminated element body 10 obtained by laminating a plurality of base material layers including base material layers S1 to S9 and a primary coil and a secondary coil which are provided on the laminated element body and are coupled to each other.

As shown in FIG. 11, conductor patterns are formed on the base material layers S1 to S9. Conductor patterns 11 to 13, conductor patterns 21 to 24 and conductor patterns 51 to 53 are formed on the base material layers S1 to S3, the base material layers S3 to S6 and the base material layers S6 to S8, respectively. Moreover, conductor patterns 31 to 33, conductor patterns 41 and 42 and conductor patterns 61 to 63 are formed on the base material layers S1 to S3, the base material layers S4 and S5 and the base material layers S6 to S8, respectively. Dashed lines extending in a vertical direction in FIG. 1 indicate via conductors, which connect the conductor patterns to each other using interlayers.

A first coil element L1*a* is formed by the conductor patterns 11 to 13 and via conductors connecting them. Moreover, a second coil element L1*b* is formed by the conductor patterns 21 to 23 and via conductors connecting them. Furthermore, a fifth coil element L1*c* is formed by the conductor patterns 51 to 53 and via conductors connecting them. In addition, a third coil element L2*a* is formed by the conductor patterns 31 to 33 and via conductors connecting them. Moreover, a fourth coil element L2*b* is formed by the conductor patterns 41 and 42 and via conductors connecting them. Furthermore, a sixth coil element L2*c* is formed by the conductor patterns 61 to 63 and via conductors connecting them.

In FIG. 11, an end of the first coil element L1*a* is used as a port P1 and an end of the fifth coil element L1*c* is used as a port P2. Moreover, an end of the third coil element L2*a* is used as port P3 and an end of the sixth coil element L2*c* is used as a port P4.

Nonlinear resistance elements 91 and 92 such as varistors are formed on the base material layer S9. These nonlinear resistance elements 91 and 92 are connected between the ports P2 and P4 and a ground port GND. The nonlinear resistance elements 91 and 92 can be obtained by a sintered body of zinc oxide paste printed across a pair of land electrodes, for example.

As shown in FIG. 12, a ground port GND is formed together with the input/output ports P1 to P4 in the high frequency component 103.

Figure 13:
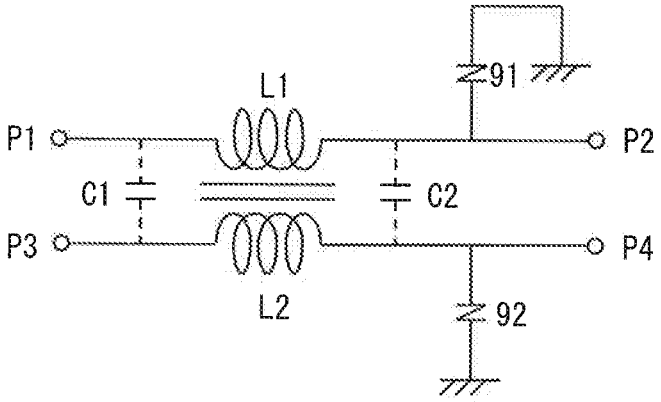
FIG. 13 is an equivalent circuit diagram showing the high frequency component 103.

FIG. 13 is an equivalent circuit diagram showing the high frequency component 103. The high frequency component 103 is an element in which a primary coil L1 has first and second ends serving as ports P1 and P2 and a secondary coil L2 has first and second ends serving as ports P3 and P4. Additionally, the nonlinear resistance elements 91 and 92 are connected between the ports P2 and P4 and the ground.

For example, a feeder circuit is connected between the ports P1 and P3. For example, a digital signal processing circuit is connected between the ports P2 and P4.

When static electricity exceeding a voltage to be protected is applied to the port P1, the nonlinear resistance element 91 is conducted to obtain a low impedance. Consequently, the static electricity applied to the port P1 is shunted to the ground through the nonlinear resistance element 91. When the static electricity exceeding the voltage to be protected is applied to the port P3, similarly, the nonlinear resistance element 92 is conducted to obtain a low impedance. Consequently, the static electricity applied to the port P3 is shunted to the ground through the nonlinear resistance element 92.

It may be preferable that the nonlinear resistance elements 91 and 92 are provided at an opposite side to a side where the static electricity enters in relation to each coil. The nonlinear resistance element, such as a varistor, has a poorer transient response than a discharge type element. For this reason, in some cases in which rush current sharply enters the nonlinear resistance element, the nonlinear resistance element is broken. If the primary coil L1 or the secondary coil L2 is disposed in a former stage of the nonlinear resistance element, however, it is possible to delay a rise time of the rush current by these coils, thereby protecting the nonlinear resistance element. Moreover, it is possible to reduce a suppression voltage through static electricity. For example, when static electricity (ESD: Electro-Static Discharge) of 8 kV is input, the suppression voltage is approximately 600 Vpp in the case in which only the nonlinear resistance element is used. By combining the nonlinear resistance element and these coils, it is possible to control the suppression voltage to be 300 Vpp or less.

In the case in which the nonlinear resistance elements 91 and 92 are obtained by firing zinc oxide paste, for example, it is possible to fire them in co-firing for a laminated body of a dielectric ceramic green sheet. In this connection, generally, ferrite ceramic cannot be fired in a reducing atmosphere. For this reason, it is difficult to configure a varistor formed of zinc oxide in the co-firing. However, this problem is not caused by using a dielectric ceramic base material layer.

Although the two ground ports are provided in the example shown in FIGS. 11 to 13, it is also possible to provide a single common ground port. Moreover, it is also possible to provide the nonlinear resistance element only between the port P2 and the ground or between the port P4 and the ground.

In each of the embodiments described above, it is a matter of course that the number of turns of the coil and the number of crossing times of the primary coil and the secondary coil in the views showing the structure of the laminated body are illustrative, and the number of turns and the number of crossing times of each coil element are not restricted to those shown in these drawings. It is preferable to determine them depending on a desirable characteristic. In particular, the number of turns of each coil element contributes to the determination of an impedance in a normal mode. Moreover, the number of crossing times of the primary coil and the secondary coil contributes to a degree of coupling of the primary coil and the secondary coil. If the number of crossing times of the primary coil and the secondary coil is even-numbered, the directions of the input port (P1, P3) and the output port (P2, P4) are not inverted, which can be advantageous. In other words, straight arrangement is made from the port P1 to the port P2 and from the port P3 to the port P4. Therefore, it is possible to easily form a mounting pattern for the common mode choke coil over a differential transmission line formed on a printed wiring board.

Fourth Embodiment

Figure 14:
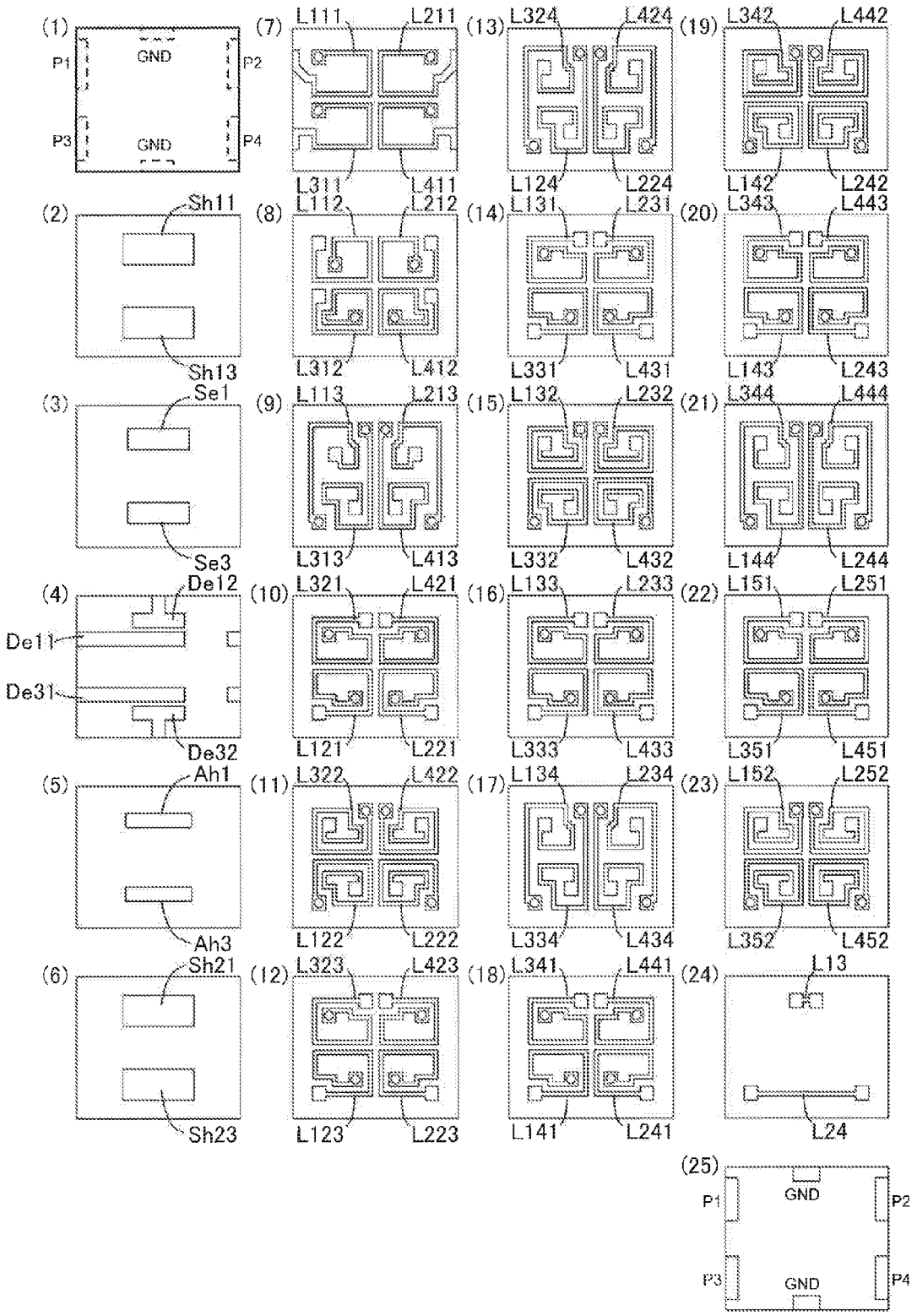
FIG. 14 is an exploded plan view showing a conductor pattern of each layer in a high frequency component or the like according to a fourth embodiment.
Figure 15:
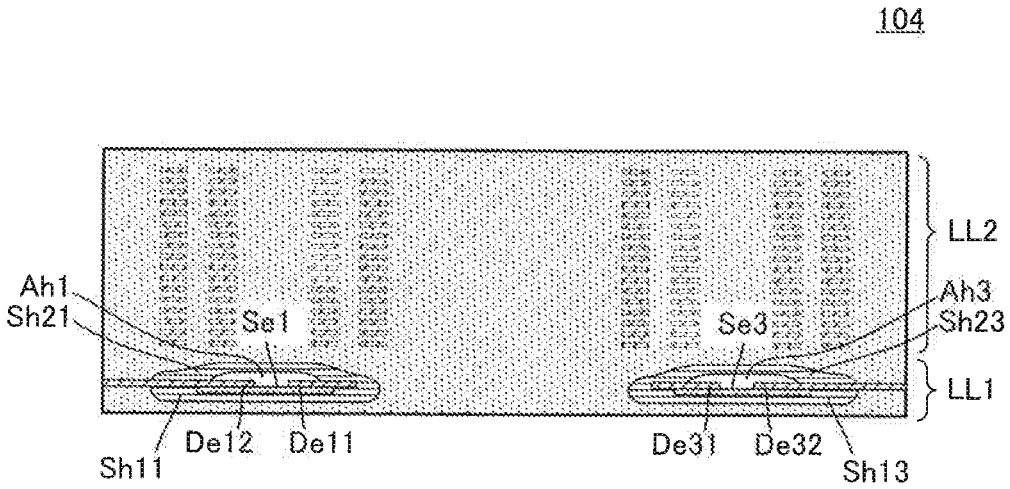
FIG. 15 is a sectional view showing a high frequency component 104 according to the fourth embodiment.
Figure 16:
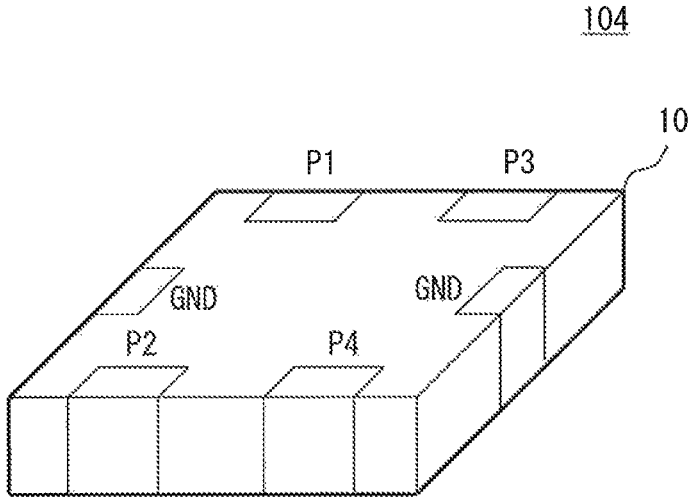
FIG. 16 is a perspective view showing an external appearance of the high frequency component 104.

FIG. 14 is an exploded plan view showing a conductor pattern of each layer in a high frequency component or the like according to a fourth embodiment. FIG. 15 is a sectional view showing a high frequency component 104 according to the fourth embodiment. FIG. 16 is a perspective view showing an external appearance of the high frequency component 104.

In FIG. 14, (1) to (25) indicate shapes of conductor patterns formed on respective layers of a laminated body corresponding to the respective layers. (1) indicates a lowermost layer and (25) indicates an uppermost layer. A lower surface (a bottom surface) of the lowermost layer (1) is a mounting surface for a wiring board to be amounting destination. External electrodes serving as input/output ports P1, P2, P3 and P4 and a ground port GND are formed on the lower surface of the lowermost layer (1) (see FIG. 16). Shield layers Sh11 and Sh13 are formed on the second layer (2). Auxiliary discharge electrodes Se1 and Se3 are formed on the third layer (3). Discharge electrodes De11, De12, De31 and De32 are formed on the fourth layer (4). Cavities Ah1 and Ah3 are formed on the fifth layer (5). Shield layers Sh21 and Sh23 are formed on the sixth layer (6). The second layer (2) to the fifth layer (5) are not formed on individual green sheets respectively but an upper surface of the lowermost layer (1) is re-coated with them. A lamination structure in this part will be described later in detail.

Conductor patterns L111, L211, L311 and L411 to be conducted to the input/output ports P1, P2, P3 and P4 are formed on the seventh layer (7).

Conductor patterns L112, L212, L312 and L412 to be conducted to the conductor patterns L111, L211, L311 and L411 are formed on the eighth layer (8).

Conductor patterns L113, L213, L313 and L413 to be conducted to the conductor patterns L112, L212, L312 and L412 are formed on the ninth layer (9).

Conductor patterns L121, L221, L321 and L421 to be conducted to the conductor patterns L113, L213, L313 and L413 are formed on the tenth layer (10).

Conductor patterns L122, L222, L322 and L422 to be conducted to the conductor patterns L121, L221, L321 and L421 are formed on the eleventh layer (11).

Conductor patterns L123, L223, L323 and L423 to be conducted to the conductor patterns L122, L222, L322 and L422 are formed on the twelfth layer (12).

Conductor patterns L124, L224, L324 and L424 to be conducted to the conductor patterns L123, L223, L323 and L423 are formed on the thirteenth layer (13).

Conductor patterns L131, L231, L331 and L431 to be conducted to the conductor patterns L124, L224, L324 and L424 are formed on the fourteenth layer (14).

Conductor patterns L132, L232, L332 and L432 to be conducted to the conductor patterns L131, L231, L331 and L431 are formed on the fifteenth layer (15).

Conductor patterns L133, L233, L333 and L433 to be conducted to the conductor patterns L132, L232, L332 and L432 are formed on the sixteenth layer (16).

Conductor patterns L134, L234, L334 and L434 to be conducted to the conductor patterns L133, L233, L333 and L433 are formed on the seventeenth layer (17).

Conductor patterns L141, L241, L341 and L441 to be conducted to the conductor patterns L134, L234, L334 and L434 are formed on the eighteenth layer (18).

Conductor patterns L142, L242, L342 and L442 to be conducted to the conductor patterns L141, L241, L341 and L441 are formed on the nineteenth layer (19).

Conductor patterns L143, L243, L343 and L443 to be conducted to the conductor patterns L142, L242, L342 and L442 are formed on the twentieth layer (20).

Conductor patterns L144, L244, L344 and L444 to be conducted to the conductor patterns L143, L243, L343 and L443 are formed on the twenty-first layer (21).

Conductor patterns L151, L251, L351 and L451 to be conducted to the conductor patterns L144, L244, L344 and L444 are formed on the twenty-second layer (22).

Conductor patterns L152, L252, L352 and L452 to be conducted to the conductor patterns L151, L251, L351 and L451 are formed on the twenty-third layer (23).

A conductor pattern L13 to be conducted to the conductor patterns L152 and L252, and a conductor pattern L24 to be conducted to the conductor patterns L352 and L452 are formed on the twenty-fourth layer (24).

External electrodes serving as the input/output ports P1, P2, P3 and P4 and the ground port GND are formed on the upper surface of the uppermost layer (25).

The conductor patterns formed on the seventh layer (7) to the twenty-fourth layer (24) configure a plurality of coil elements.

In FIG. 15, the shield layers Sh11 and Sh13, the auxiliary discharge electrodes Se1 and Se3, the discharge electrodes De11, De12, De31 and De32, the cavities Ah1 and Ah3, and the shield layers Sh21 and Sh23 are formed on a laminated portion LL1. The conductor patterns configuring the plurality of coil elements are formed in a laminated portion LL2. A connection relationship between the respective coil elements will be described later in detail.

Figure 17:
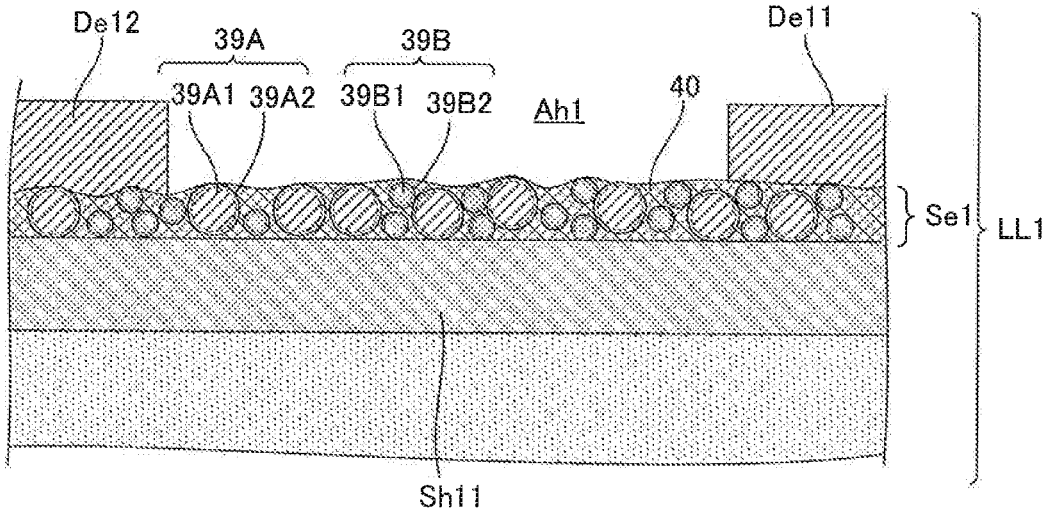
FIG. 17 is a schematic view illustrating an enlarged sectional structure of a portion including discharging electrodes De11 and De12 in the high frequency component 104.

FIG. 17 is a schematic view illustrating an enlarged sectional structure of a portion including the discharge electrodes De11 and De12. A sectional structure of a portion including the discharge electrodes De31 and De32 is also the same. In this example, the shield layer Sh11 is an insulating ceramic layer and is provided to prevent a glass component from oozing from the base material to the auxiliary discharge electrode Se1 portion in the integral firing of an LTCC (Low Temperature Co-fired Ceramics) green sheet serving as the base material.

The auxiliary discharge electrode Se1 includes auxiliary discharge materials 39A and 39B. The auxiliary discharge material 39A has a particulate metallic material 39A1 and an insulating film 39A2 provided on a surface of the metallic material 39A1. Moreover, the auxiliary discharge material Se1 has a particulate semiconductor material 39B1 and an insulating film 39B2 provided on a surface of the semiconductor material 39B1. Herein, the metallic material 39A1 is a Cu particle and the semiconductor material 39B1 is an SiC particle. Moreover, the insulating film 39A2 is an alumina film and the insulating film 39B2 is a $SiO_2$ film obtained by oxidizing the semiconductor material 39B1.

Moreover, a glassy substance 40 is formed on the auxiliary discharge electrode Se1 to surround the auxiliary discharge materials 39A and 39B. The glassy substance 40 is not formed intentionally but formed by a reaction such as oxidation of a constituent material or the like which is derived from a peripheral member of a sacrifice layer to be used for forming the cavity Ah1.

By the structure shown in FIG. 17, when a high voltage is applied between the discharge electrodes De11 and De12, (1) creeping discharge of the auxiliary discharge electrode Se1, (2) aerial discharge between the discharge electrodes De11 and De12 and (3) discharge to be propagated through the auxiliary discharge materials 39A and 39B like stepping stones occur. By the discharge, static electricity is discharged.

The high frequency component 104 shown in FIGS. 15 and 17 is manufactured by a material through a process which will be described below.

For the shield layers Sh11 and Sh13 in the laminated portion LL1, alumina paste containing alumina powder as a main component is used, for example. Moreover, electrode paste for forming a discharge electrode is obtained by adding a solvent to a binder resin constituted by Cu powder, ethylcellulose and the like and stirring and mixing them.

Resin paste to be a starting point for forming the cavities Ah1 and Ah3 is also prepared by the same method. The resin paste is constituted by only a resin and a solvent. A resin to be decomposed and disappear in firing is used for a resin material. For example, the resin material includes PET, polypropylene, an acrylic resin and the like.

Mixed paste for forming the auxiliary discharge electrodes Se1 and Se3 is obtained by compounding Cu powder as a conductive material and $BaO—Al_2O_3—SiO_2$ based ceramic powder (BAS material powder) as a ceramic material at a predetermined rate, adding a binder resin and a solvent and stirring and mixing them.

The paste for the shield layers Sh11 and Sh13 is applied to a green sheet to be a base, the electrode paste for a discharge electrode is then applied, the resin paste for forming the cavities Ah1 and Ah3 is applied, and furthermore, the paste for the shield layers Sh21 and Sh23 is applied.

The laminated portion LL2 shown in FIG. 15 is configured by laminating a ceramic green sheet and carrying out pressure bonding in the same manner as an ordinary ceramic multilayer substrate.

The laminated body thus bonded by pressure is cut by means of a microcutter in the same manner as an electronic component of a chip type, for example, an LC filter and is thus separated into element bodies. Thereafter, the electrode paste serving as various external terminals after firing is applied onto end faces of the element bodies.

In the same manner as an ordinary ceramic multilayer substrate, subsequently, the firing is carried out in an $N_2$ atmosphere. In the case in which a rare gas such as Ar or Ne is introduced into the cavity portion in order to reduce a response voltage to ESD, it may be preferable that a temperature range in which the shrinkage and sintering of the ceramic material is performed should be fired in a rare gas atmosphere such as Ar or Ne. In the case in which the discharge electrodes De11, D12, De31 and De32 and the external electrode are electrode materials which are not oxidized, the firing may be carried out in an air atmosphere.

In the same manner as an electronic component of a chip type, for example, an LC filter, thereafter, an Ni—Sn plating film is formed on the surface of the external electrode by electrolytic Ni—Sn plating.

Figure 18A:
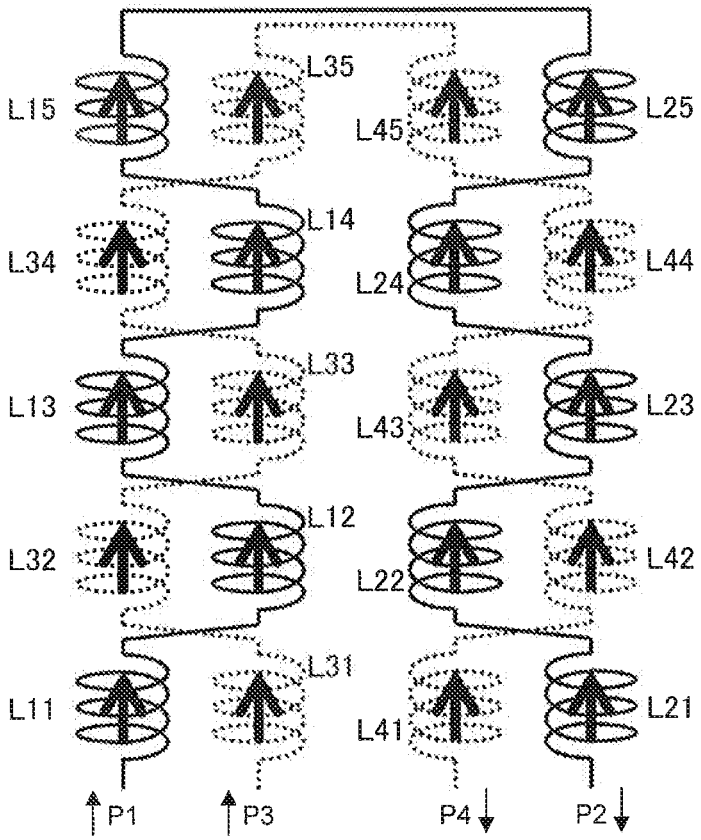
FIGS. 18A and 18B are views showing directions of currents and magnetic fluxes in a common mode and a normal mode (a differential mode), respectively in a common mode choke coil portion of the high frequency component according to the fourth embodiment.
Figure 18B:
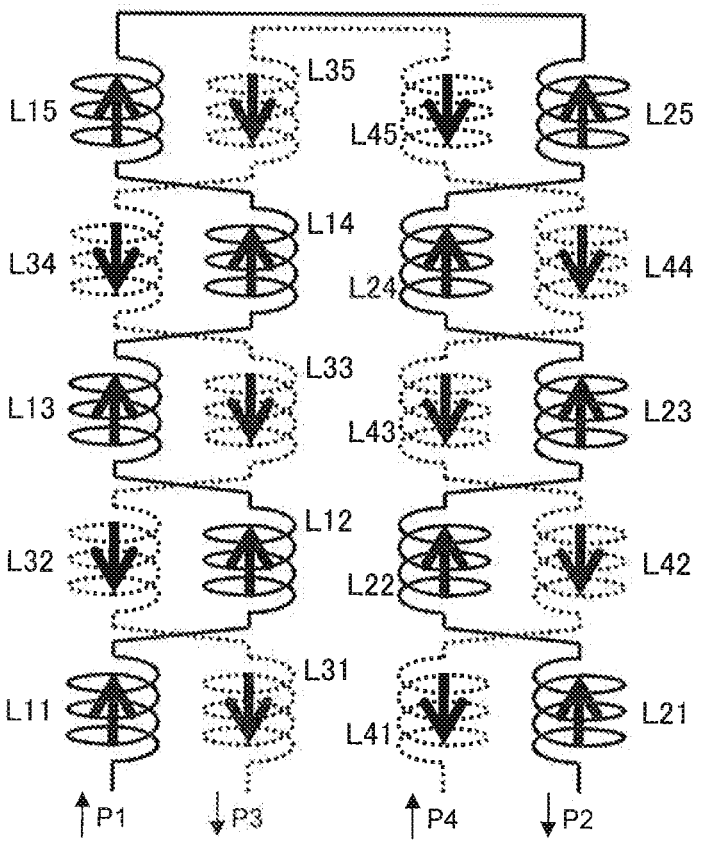

FIGS. 18A and 18B are views showing directions of currents and magnetic fluxes in a common mode and a normal mode (a differential mode), respectively in the common mode choke coil portion of the high frequency component according to the fourth embodiment.

As shown in FIG. 18A, when the common mode current flows, a direction of a magnetic flux generated on the primary coil formed by the coil elements L11, L12, L13, L14 and L15 is coincident with a direction of a magnetic flux generated on the secondary coil formed by the coil elements L31, L32, L33, L34 and L35. Moreover, a direction of a magnetic flux generated on the primary coil formed by the coil elements L25, L24, L23, L22 and L21 is coincident with a direction of a magnetic flux generated on the secondary coil formed by the coil elements L45, L44, L43, L42 and L41. Therefore, magnetic fields are mutually increased so that a great inductance value can be obtained. Consequently, impedance is increased so that the common mode current (a common mode noise) is suppressed.

As shown in FIG. 18B, when the normal mode current flows, the direction of the magnetic flux generated on the primary coil formed by the coil elements L11, L12, L13, L14 and L15 is in the reverse direction of the magnetic flux generated on the secondary coil formed by the coil elements L31, L32, L33, L34 and L35. Therefore, the coil elements which are transversely adjacent to each other configure a closed magnetic circuit so that the magnetic flux is confined. In other words, the coil elements (L11, L31) configure a single closed magnetic circuit, the coil elements (L12, L32) configure a single closed magnetic circuit, and the coil elements (L13, L33) configure a single closed magnetic circuit. Similarly, the coil elements (L14, L34), (L15, L35), (L21, L41), (L22, L42), (L23, L43), (L24, L44) and (L25, L45) configure closed magnetic circuits, respectively.

Thus, magnetic fields are mutually reduced so that the inductance value is decreased. Consequently, the impedance is reduced so that the normal mode current (a normal mode signal) is transmitted with a small loss.

A magnetic path of a magnetic flux in the flow of the common mode current shown in FIG. 18A configures an open magnetic circuit. Accordingly, the inductance value is great. On the other hand, a magnetic path of a magnetic flux in the flow of the normal mode current shown in FIG. 18B configures the closed magnetic circuit. Since all of the magnetic paths are closed, the inductance value is small. In particular, the directions of the magnetic fluxes of the coil elements which are adjacent to each other in a coil winding axis direction are the reverse of each other (a direction in which the magnetic fluxes repel each other). Therefore, a magnetic barrier is generated between the coil elements. In other words, a magnetic barrier is generated between the closed magnetic circuits which are adjacent to each other in the coil winding axis direction. Accordingly, the magnetic field in the closed magnetic circuit interposed between the magnetic barriers has a high confinement property so that a leakage magnetic flux can be suppressed more greatly. Therefore, a sufficient coupling value can be obtained between the primary coil and the secondary coil.

Moreover, displacement current and induction current flow in the same direction in the coil elements which are adjacent to each other in the coil winding axis direction. Therefore, a transmission loss of the normal mode signal is reduced.

Figure 19:
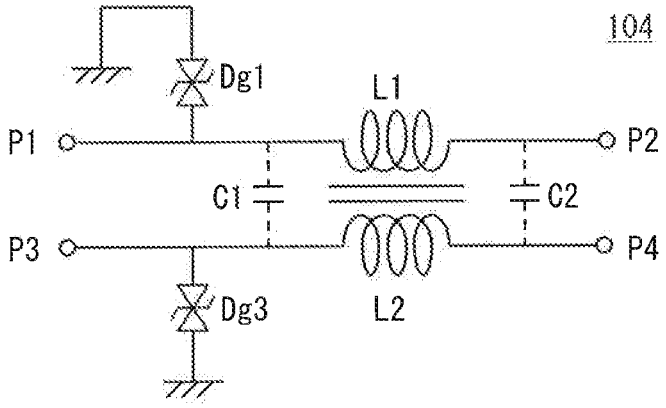
FIG. 19 is an equivalent circuit diagram showing the high frequency component 104 according to the fourth embodiment.
Figure 20:
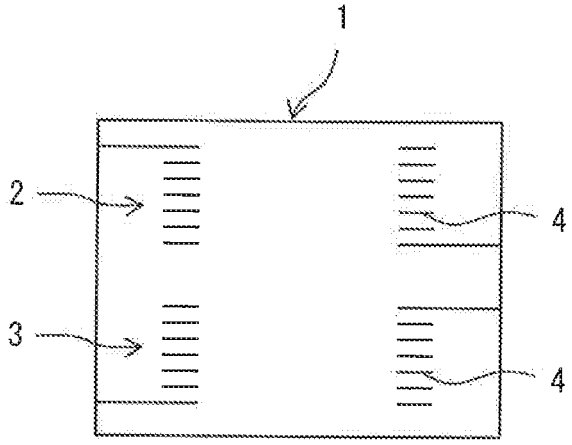
FIG. 20 is a sectional view showing the common mode choke coil described in the Patent Literature 1.

FIG. 19 is an equivalent circuit diagram showing the high frequency component 104 according to the fourth embodiment. By the structure described above, the primary coil L1 has first and second ends serving as the ports P1 and P2 and the secondary coil L2 has first and second ends serving as the ports P3 and P4. In other words, the primary coil L1 includes a series circuit formed by the coil elements L11, L12, L13, L14, L15, L25, L24, L23, L22 and L21. Moreover, the secondary coil L2 includes a series circuit formed by the coil elements L31, L32, L33, L34, L35, L45, L44, L43, L42 and L41.

For example, a feeder circuit is connected between the ports P1 and P3. For example, a digital signal processing circuit is connected between the ports P2 and P4. Capacitors C1 and C2 in FIG. 19 equivalently represent stray capacitances between the primary coil L1 and the secondary coil L2.

When static electricity exceeding a voltage to be protected is applied to the port P1, a discharge element Dg1 formed by the discharge electrode and the auxiliary discharge electrode is discharged (conducted) so that impedance is reduced. Consequently, the static electricity applied to the port P1 is shunted to the ground through the discharge element Dg1. When the static electricity exceeding the voltage to be protected is applied to the port P3, similarly, a discharge element Dg3 is conducted so that the impedance is reduced. Consequently, the static electricity applied to the port P3 is shunted to the ground through the discharge element Dg3.

It may be preferable that the discharge elements Dg1 and Dg3 are provided on a side where the static electricity enters as shown in FIG. 19. Also in the case in which an input impedance of a circuit to be connected to the ports P2 and P4 is low, particularly, the common mode choke coil formed by the primary coil L1 and the secondary coil L2 has a high impedance against a surge of a high frequency component such as the ESD. Therefore, the surge is reflected by the common mode choke coil, a high voltage is applied to the discharge elements Dg1 and Dg3, and the discharge elements Dg1 and Dg3 quickly reach a discharge voltage so that the discharge is started. Therefore, the flow of the surge to the circuit to be connected to the ports P2 and P4 can be prevented more reliably.

According to the arrangement of the coil elements shown in FIGS. 14 and 18, the capacitance generated between the ground conductor on the wiring board and each of the coil elements has high symmetry for the primary coil L1 and the secondary coil L2 in a state in which the high frequency component 104 is mounted on the wiring board. Therefore, a relationship of a phase difference of 0° in the common mode noise is maintained. Accordingly, there is not carried out the signal conversion from the common mode noise to the normal mode component due to a shift of the phase difference. Thus, the common mode noise can be prevented from flowing as a normal mode (differential mode) signal (noise).

A common mode choke coil according to the present invention can be used for a high speed interface such as a USB or an HDMI. Moreover, it is useful as a filter for a power supply circuit having a high switching frequency (for example, 1 MHz or more), a high speed BUS line (for example, a transfer rate of 600 MBit/sec) or the like.

REFERENCE SIGNS LIST

L1 primary coil
L2 secondary coil
L1*a* first coil element
L1*b* second coil element
L1*c* fifth coil element
L2*a* third coil element
L2*b* fourth coil element
L2*c* sixth coil element
P1, P2, P3, P4 input/output port
S1 to S12 base material layer
Sh11, Sh13, Sh21, Sh23 shield layer
Se1, Se3 auxiliary discharge electrode
De11, De12, De31, De 32 discharge electrode
Ah1, Ah3 cavity
9 printed wiring board
10 laminated element body
11 to 14 conductor pattern
21 to 24 conductor pattern
31 to 34 conductor pattern
41 to 44 conductor pattern
51 to 54 conductor pattern
61 to 64 conductor pattern
91, 92 nonlinear resistance element
101, 102 common mode choke coil
103, 104 high frequency component

The invention claimed is:

1. A laminated common mode choke coil comprising:
a laminated element body including:
a plurality of base material layers laminated each other,
a primary coil; and
a secondary coil, the primary coil and the secondary coil being coupled to each other,
wherein the primary coil comprises a first coil element and a second coil element which are connected in series and the secondary coil comprises a third coil element and a fourth coil element which are connected in series,
the first coil element and the fourth coil element are wound around a first winding axis, and the second coil element and the third coil element are wound around a second winding axis which is different from the first winding axis,
the first coil element and the third coil element are disposed adjacently in a layer direction of the base material layer, and the second coil element and the fourth coil element are disposed adjacently in the layer direction of the base material layer, and the first coil element and the second coil element are connected and the third coil element and the fourth coil element are connected such that a magnetic field in the same direction is generated in the first coil element, the second coil element, the third coil element and the fourth coil element when common mode current flows.

2. The laminated common mode choke coil according to claim 1, wherein the first coil element and the third coil element are formed on the same base material layer, and the second coil element and the fourth coil element are formed on the same base material layer.

3. The laminated common mode choke coil according to claim 1, wherein a capacitance is generated between the first coil element and the fourth coil element, and a capacitance is generated between the second coil element and the third coil element.

4. The laminated common mode choke coil according to claim 1, wherein the primary coil further comprises a fifth coil element connected in series to the first coil element and the second coil element, and the secondary coil further includes a sixth coil element connected in series to the third coil element and the fourth coil element, the first coil element, the fourth coil element and the fifth coil element are wound around the first winding axis, and the fourth coil element is interposed between the first coil element and the fifth coil element, the second coil element, the third coil element and the sixth coil element are wound around the second winding axis which is different from the first winding axis, and the second coil element is interposed between the third coil element and the sixth coil element, and the first coil element, the second coil element and the fifth coil element are connected and the third coil element, the fourth coil element and the sixth coil element are connected such that a magnetic field in the same direction is generated in the first coil element, the second coil element, the third coil element, the fourth coil element, the fifth coil element and the sixth coil element when common mode current flows.

5. The laminated common mode choke coil according to claim 1 further comprising a first nonlinear resistance element and a second nonlinear resistance element which are formed on the laminated element body, the first nonlinear resistance element being connected to the primary coil and the second nonlinear resistance element being connected to the secondary coil.

* * * * *